US006523209B1

(12) United States Patent
Dickerson

(10) Patent No.: US 6,523,209 B1
(45) Date of Patent: Feb. 25, 2003

(54) WALL CLEANING APPARATUS

(76) Inventor: Shari Lynn Dickerson, 101 Luna Way Unit 217, Las Vegas, NV (US) 89145

( * ) Notice: Subject to any disclaimer, the term of this patent is extended or adjusted under 35 U.S.C. 154(b) by 20 days.

(21) Appl. No.: 09/822,385

(22) Filed: Mar. 30, 2001

(51) Int. Cl.[7] ..... A46B 13/04
(52) U.S. Cl. ..... 15/97.1; 15/29
(58) Field of Search ..... 15/24, 29, 97.1

(56) References Cited

U.S. PATENT DOCUMENTS

| | | | | | |
|---|---|---|---|---|---|
| 689,464 | A | * | 12/1901 | Cramer | 15/29 |
| 978,749 | A | * | 12/1910 | Hollis | 15/24 X |
| 1,059,136 | A | * | 4/1913 | Gafney | 15/24 X |
| 1,332,640 | A | * | 3/1920 | Stanfield | 15/29 X |
| 1,679,323 | A | * | 7/1928 | Mortlock | 15/29 |
| 2,101,216 | A | * | 12/1937 | Grueschow | 15/29 X |
| 2,384,458 | A | * | 9/1945 | Dubay | 15/29 X |
| 2,608,439 | A | * | 8/1952 | Bates et al. | 15/29 X |
| 2,682,067 | A | * | 6/1954 | Coleman | 15/29 X |
| 2,730,738 | A | * | 1/1956 | Humes | 15/24 |
| 2,744,271 | A | * | 5/1956 | Florence | 15/29 |
| 2,756,446 | A | * | 7/1956 | Chittum | 15/29 |
| 2,806,236 | A | * | 9/1957 | Di Stefano | 15/29 |
| 3,138,815 | A | * | 6/1964 | James, Jr. | 15/24 X |
| 3,467,977 | A | | 9/1969 | Helm | |
| 3,606,631 | A | * | 9/1971 | Vassh et al. | 15/29 |
| 3,648,316 | A | * | 3/1972 | Habian et al. | 15/24 X |
| 3,988,799 | A | * | 11/1976 | Strickland | 15/97.1 |
| 4,175,300 | A | * | 11/1979 | McGlew et al. | 15/24 X |
| 4,302,122 | A | * | 11/1981 | Moya | 15/24 X |
| 4,778,298 | A | | 10/1988 | Shin et al. | |
| 4,779,299 | A | * | 10/1988 | Cutler | 15/97.1 |
| 4,825,496 | A | * | 5/1989 | Taylor | 15/24 |
| 4,893,375 | A | | 1/1990 | Girman et al. | |
| D315,251 | S | | 3/1991 | Clivio | |
| 5,235,937 | A | * | 8/1993 | Farina et al. | 15/24 X |
| 5,271,682 | A | | 12/1993 | Realdon | |
| 5,649,334 | A | | 7/1997 | Henriquez et al. | |

FOREIGN PATENT DOCUMENTS

| | | | | |
|---|---|---|---|---|
| FR | 1281617 | * | 12/1961 | 15/29 |
| GB | 2164246 | * | 3/1986 | 15/24 |
| IT | 289005 | * | 7/1935 | 15/97.1 |

* cited by examiner

*Primary Examiner*—Mark Spisich

(57) ABSTRACT

A wall cleaning apparatus for making it easier for the user to clean the walls. The wall cleaning apparatus includes a container assembly including a container mounted upon wheels and also including a lid assembly being removably disposed upon the container with the container being adapted to hold cleaning solutions; and also includes a pump assembly being attached to the container and including a flexible hose; and further including a tubular head support attachment being removably connected to the flexible hose; and also including a head assembly being rotatably mounted to the tubular head support attachment; and further includes a rotating assembly for rotating the head assembly.

8 Claims, 3 Drawing Sheets

WALL CLEANING APPARATUS

BACKGROUND OF THE INVENTION

1. Field of the Invention

The present invention relates to wall cleaners and more particularly pertains to a new wall cleaning apparatus for making it easier for the user to clean the walls.

2. Description of the Prior Art

The use of wall cleaners is known in the prior art. More specifically, wall cleaners heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,467,977; U.S. Pat. No. 5,271,682; U.S. Pat. No. 5,649,334; U.S. Pat. No. 4,893,375; U.S. Pat. No. 4,778,298; and U.S. Pat. No. Des. 315,251.

While these devices fulfill their respective, particular objectives and requirements, the aforementioned patents do not disclose a new wall cleaning apparatus. The inventive device includes a container assembly including a container mounted upon wheels and also including a lid assembly being removably disposed upon the container with the container being adapted to hold cleaning solutions; and also includes a pump assembly being attached to the container and including a flexible hose; and further including a tubular head support attachment being removably connected to the flexible hose; and also including a head assembly being rotatably mounted to the tubular head support attachment; and further includes a means for rotating the head assembly.

In these respects, the wall cleaning apparatus according to the present invention substantially departs from the conventional concepts and designs of the prior art, and in so doing provides an apparatus primarily developed for the purpose of making it easier for the user to clean the walls.

SUMMARY OF THE INVENTION

In view of the foregoing disadvantages inherent in the known types of wall cleaners now present in the prior art, the present invention provides a new wall cleaning apparatus construction wherein the same can be utilized for making it easier for the user to clean the walls.

The general purpose of the present invention, which will be described subsequently in greater detail, is to provide a new wall cleaning apparatus which has many of the advantages of the wall cleaners mentioned heretofore and many novel features that result in a new wall cleaning apparatus which is not anticipated, rendered obvious, suggested, or even implied by any of the prior art wall cleaners, either alone or in any combination thereof.

To attain this, the present invention generally comprises a container assembly including a container mounted upon wheels and also including a lid assembly being removably disposed upon the container with the container being adapted to hold cleaning solutions; and also includes a pump assembly being attached to the container and including a flexible hose; and further including a tubular head support attachment being removably connected to the flexible hose; and also including a head assembly being rotatably mounted to the tubular head support attachment; and further includes a means for rotating the head assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new wall cleaning apparatus which has many of the advantages of the wall cleaners mentioned heretofore and many novel features that result in a new wall cleaning apparatus which is not anticipated, rendered obvious, suggested, or even implied by any of the prior art wall cleaners, either alone or in any combination thereof.

It is another object of the present invention to provide a new wall cleaning apparatus which may be easily and efficiently manufactured and marketed.

It is a further object of the present invention to provide a new wall cleaning apparatus which is of a durable and reliable construction.

An even further object of the present invention is to provide a new wall cleaning apparatus which is susceptible of a low cost of manufacture with regard to both materials and labor, and which accordingly is then susceptible of low prices of sale to the consuming public, thereby making such wall cleaning apparatus economically available to the buying public.

Still yet another object of the present invention is to provide a new wall cleaning apparatus which provides in the apparatuses and methods of the prior art some of the advantages thereof, while simultaneously overcoming some of the disadvantages normally associated therewith.

Still another object of the present invention is to provide a new wall cleaning apparatus for making it easier for the user to clean the walls.

Yet another object of the present invention is to provide a new wall cleaning apparatus which includes a container assembly including a container mounted upon wheels and also including a lid assembly being removably disposed upon the container with the container being adapted to hold cleaning solutions; and also includes a pump assembly being attached to the container and including a flexible hose; and further including a tubular head support attachment being removably connected to the flexible hose; and also including a head assembly being rotatably mounted to the tubular head support attachment; and further includes a means for rotating the head assembly.

Still yet another object of the present invention is to provide a new wall cleaning apparatus that is easy and convenient to set up and use.

Even still another object of the present invention is to provide a new wall cleaning apparatus that reduces the amount of strain placed upon the user cleaning walls and also lessens the amount of time spent by the user cleaning the walls.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
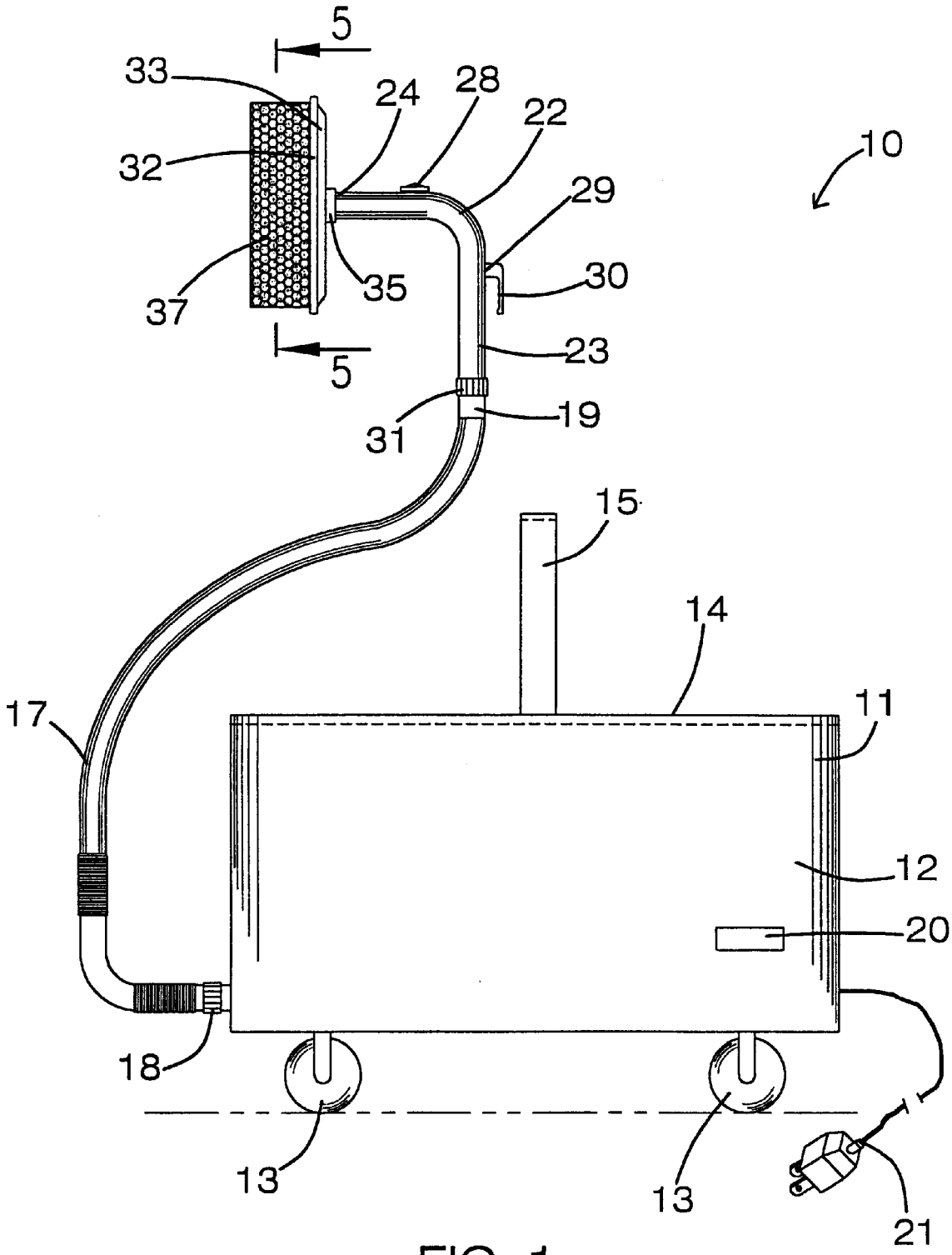
FIG. 1 is a side elevational view of a new wall cleaning apparatus according to the present invention.
Figure 2:
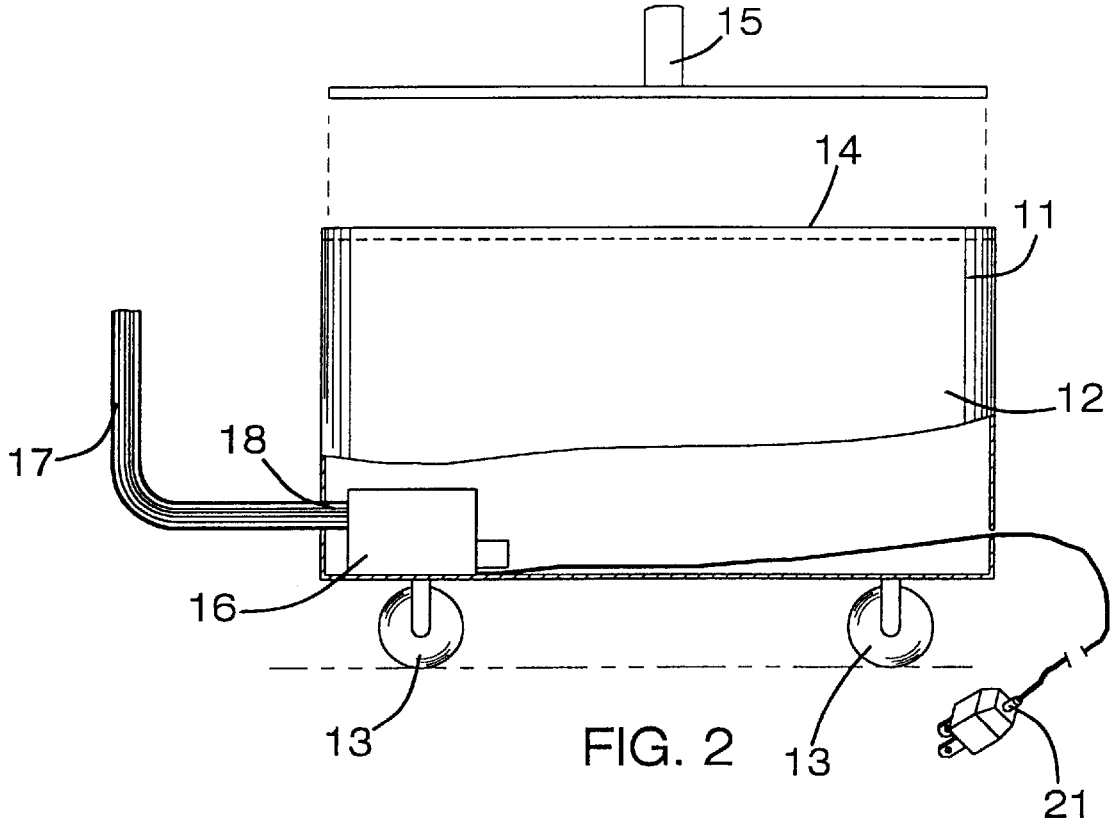
FIG. 2 is a cross-sectional view of the container of the present invention.
Figure 3:
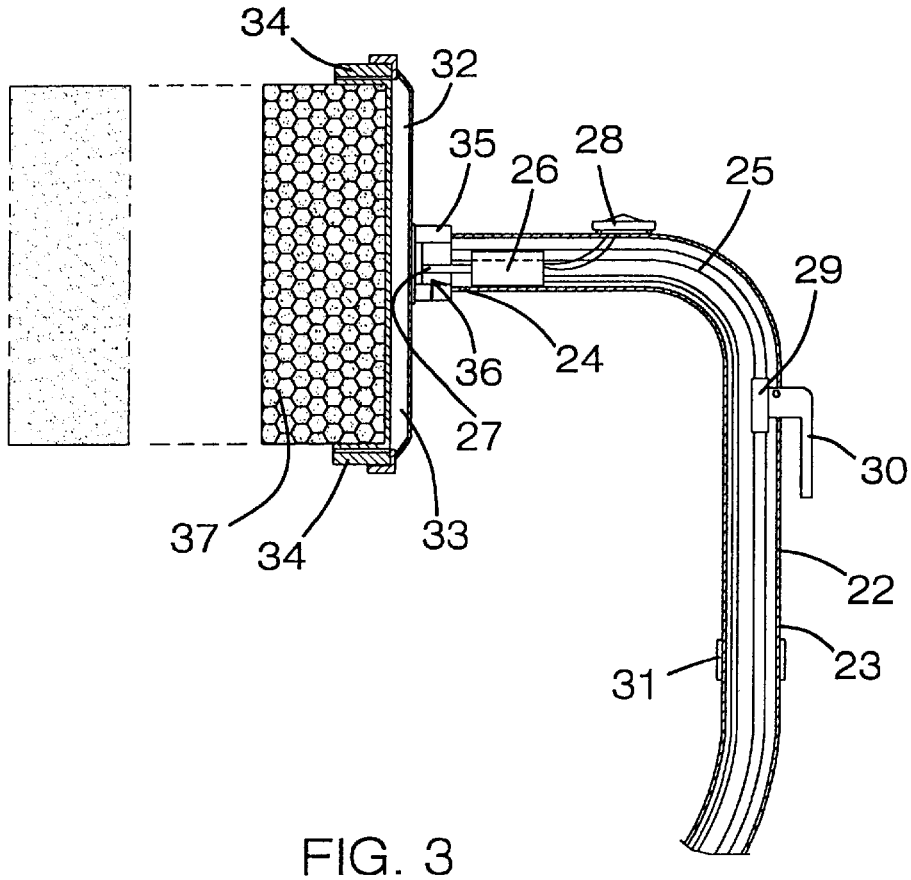
FIG. 3 is a partial cross-sectional view of the hose and the head assembly including sponge of the present invention.
Figure 4:
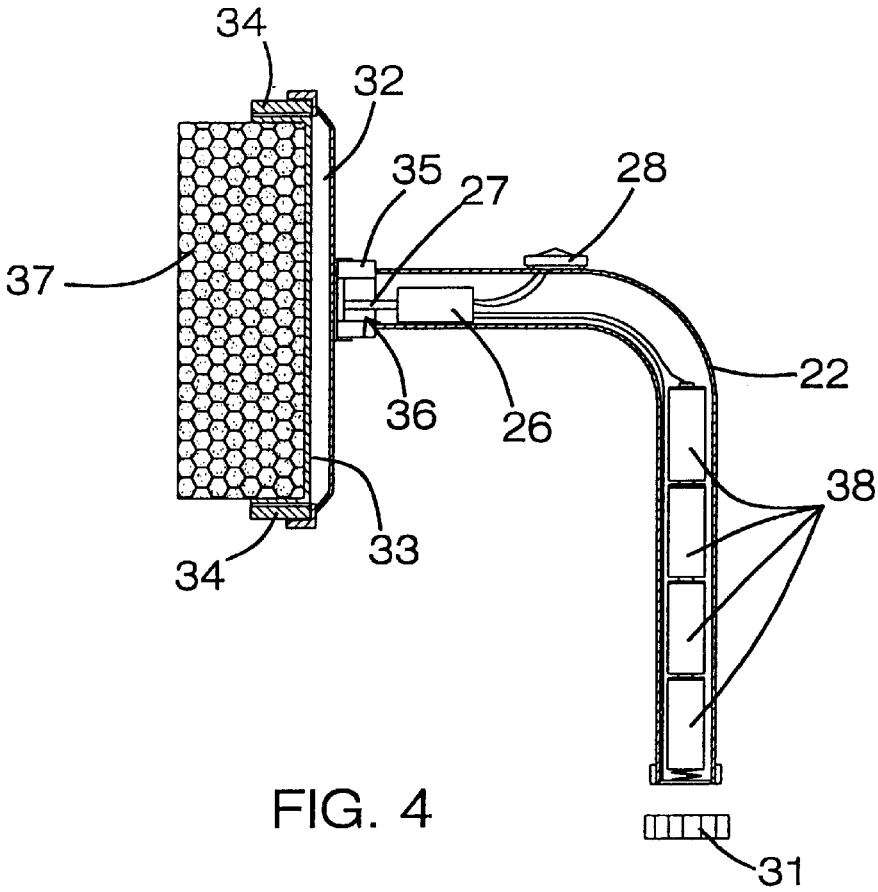
FIG. 4 is a cross-sectional view of a second embodiment of the present invention.
Figure 5:
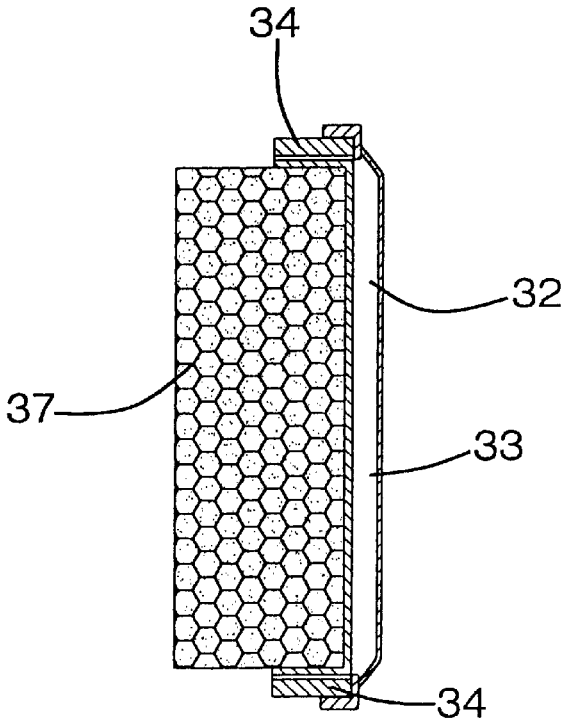
FIG. 5 is a detailed side elevational view of the head assembly of the present invention.

With reference now to the drawings, and in particular to FIGS. 1 through 5 thereof, a new wall cleaning apparatus embodying the principles and concepts of the present invention and generally designated by the reference numeral 10 will be described.

As best illustrated in FIGS. 1 through 5, the wall cleaning apparatus 10 generally comprises a container assembly including a container 11 conventionally mounted upon wheels 13 and also including a lid assembly being removably disposed upon the container 11. The container 11 is adapted to hold cleaning solutions. The lid assembly includes a lid 14 and a handle 15 being conventionally attached to the lid 14.

A pump assembly is conventionally attached to the container 11 and includes a flexible hose 17. The pump assembly further includes a pump 16 being conventionally disposed in the container 11. The flexible hose 17 has a first end 18 which is conventionally attached to the pump 16. The pump assembly also includes a power switch 20 being conventionally attached to an exterior of the container 11 and being connected with wires to the pump 16. The pump assembly further includes a power cord 21 being conventionally connected to the pump 16 and being adapted to be plugged to an electrical outlet to energize the pump 16.

A tubular head support attachment is removably connected to the flexible hose 17. The tubular head support attachment includes an angled tubular member 22 having a bore disposed therethrough, and also includes a fastening member 31 being conventionally attached to a first end 23 thereof and being fastenable to a second end 19 of the flexible hose 17, and further includes a conduit 25 being disposed in the bore of the tubular member 22 and being conventionally connected to the flexible hose 17 for transporting cleaning solutions therethrough. The pump assembly further includes a trigger-like valve member 29 being conventionally disposed in line of the conduit 25 and extends externally of the tubular member 22. The trigger-like valve member 29 includes a lever 30 being pivotally attached to the conduit 25 and being disposed externally of the tubular member 22.

A head assembly is rotatably mounted to the tubular head support attachment. The head assembly includes a head member 32 being rotatably attached to a second end 24 of the tubular member 22, and also includes a sponge 37 being engaged to the head member 32. The head member 32 includes a main wall 33, and also includes an annular side wall 34 being conventionally attached along a perimeter of the main wall 33 and being adapted to engage and hold the sponge 37, and further includes a boss 35 being conventionally attached to the main wall 33 and having a bore 36 disposed therethrough and being rotatably mounted upon the second end 24 of the tubular member 22.

A means for rotating the head assembly includes a motor 26 being conventionally disposed in the tubular member 22 near the second end 24 thereof, and also includes a shaft 27 being rotatably connected to the motor 26 and being conventionally connected to the boss 35, and further includes a switch member 28 being conventionally attached to an exterior of the tubular member 22 and being connected with wires to the motor 26 for energizing the motor 26, and also includes a power source 38 being connected with wires to the switch member 28 and to the motor 26. The power source 38 includes a battery pack being removably disposed in the tubular member 22.

In use, the user turns on the pump 16 which urges the cleaning solutions from the container 11 and through the flexible hose 17; whereupon, the user controls the amount of cleaning solution being dispensed upon the sponge 37 by manipulating the lever 30 of the trigger-like valve member 29. The user also energizes the rotation of the head member 32 by turning on the switch member 28, and places the rotating sponge 37 upon the wall for the cleaning thereof.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wall cleaning apparatus comprising:

a container assembly including a container mounted upon wheels and also including a lid assembly being removably disposed upon said container, said container being adapted to hold cleaning solutions;

a pump assembly being attached to said container and including a flexible hose;

a tubular head support attachment being removably connected to said flexible hose;

a head assembly being rotatably mounted to said tubular head support attachment;

a means for rotating said head assembly;

said tubular head support attachment including an angled tubular member having a bore disposed therethrough, and also includes a fastening member being attached to a first end thereof and being fastenable to a second end of said flexible hose;

said head assembly including a head member being rotatably attached to a second end of said tubular member, and also includes a sponge being engaged to said head member; and said head member including a main wall, and also includes an annular side wall being attached along a perimeter of said main wall and engaging and holding said sponge, and further includes a boss being attached to said main wall and having a bore disposed therethrough and being rotatably mounted upon said second end of said tubular member, said annular side wall being positioned around said sponge to inhibit substantial deformation of said sponge when said sponge is pressed against a wall.

2. A wall cleaning apparatus as described in claim 1, wherein said lid assembly includes a lid and a handle being attached to said lid.

3. A wall cleaning apparatus as described in claim 1, wherein said pump assembly further includes a pump being disposed in said container, said flexible hose having a first end which is attached to said pump, said pump assembly also including a power switch being attached to an exterior of said container and being connected to said pump, said pump assembly further including a power cord being connected to said pump and being adapted to be plugged to an electrical outlet to energize said pump.

4. A wall cleaning apparatus as described in claim 1, wherein said tubular head support attachment includes a conduit being disposed in said bore of said tubular member and being connected to said flexible hose for transporting cleaning solution therethrough, said pump assembly further including a trigger-like valve member being disposed inline of said conduit and extending externally of said tubular member.

5. A wall cleaning apparatus as described in claim 4, wherein said trigger-like valve member includes a lever being pivotally attached to said conduit and being disposed externally of said tubular member.

6. A wall cleaning apparatus as described in claim 1, wherein said means for rotating said head assembly includes a motor being disposed in said tubular member near said second end thereof, and also includes a shaft being rotatably connected to said motor and being connected to said boss, and further includes a switch member being attached to an exterior of said tubular member and being connected to said motor for energizing said motor, and also includes a power source being connected to said switch member and to said motor.

7. A wall cleaning apparatus as described in claim 6, wherein said power source includes a battery pack being removably disposed in said tubular member.

8. A wall cleaning apparatus comprising:

a container assembly including a container mounted upon wheels and also including a lid assembly being removably disposed upon said container, said container being adapted to hold cleaning solutions, said lid assembly including a lid and a handle being attached to said lid;

a pump assembly being attached to said container and including a flexible hose, said pump assembly further including a pump being disposed in said container, said flexible hose having a first end which is attached to said pump, said pump assembly also including a power switch being attached to an exterior of said container and being connected to said pump, said pump assembly further including a power cord being connected to said pump and being adapted to be plugged to an electrical outlet to energize said pump;

a tubular head support attachment being removably connected to said flexible hose, said tubular head support attachment including an angled tubular member having a bore disposed therethrough, and also including a fastening member being attached to a first end thereof and being fastenable to a second end of said flexible hose, and further including a conduit being disposed in said bore of said tubular member and being connected to said flexible hose for transporting cleaning solution therethrough, said pump assembly further including a trigger-like valve member being disposed inline of said conduit and extending externally of said tubular member, said trigger-like valve member including a lever being pivotally attached to said conduit and being disposed externally of said tubular member;

a head assembly being rotatably mounted to said tubular head support attachment, said head assembly including a head member being rotatably attached to a second end of said tubular member, and also including a sponge being engaged to said head member, said head member including a main wall, and also including an annular side wall being attached along a perimeter of said main wall and engaging and holding said sponge, and further including a boss being attached to said main wall and having a bore disposed therethrough and being rotatably mounted upon said second end of said tubular member, said annular side wall being positioned around said sponge to inhibit substantial deformation of said sponge when said sponge is pressed against a wall; and a means for rotating said head assembly, including a motor being disposed in said tubular member near said second end thereof, and also including a shaft being rotatably connected to said motor and being connected to said boss, and further including a switch member being attached to an exterior of said tubular member and being connected to said motor for energizing said motor, and also including a power source being connected to said switch member and to said motor, said power source including a battery pack being removably disposed in said tubular member.

* * * * *